United States Patent [19]

Bauer

[11] Patent Number: 4,777,853

[45] Date of Patent: Oct. 18, 1988

[54] BOLT STARTER FOR STARTING BOLTS AND THE LIKE THROUGH UNALIGNED HOLES

[76] Inventor: Arlen E. Bauer, Box 83, 8500 East Rd., Redwood Valley, Calif. 95470

[21] Appl. No.: 901,540

[22] Filed: Aug. 28, 1986

[51] Int. Cl.[4] ..... B25B 13/02

[52] U.S. Cl. ..... 81/125

[58] Field of Search ..... 81/125, DIG. 11, 124.2, 81/185, 184, 439, 440

[56] References Cited

U.S. PATENT DOCUMENTS

| | | | |
|---|---|---|---|
| 1,558,267 | 10/1925 | McGuckin | 81/125 |
| 2,287,233 | 7/1942 | DeFord | 81/13 |
| 2,356,400 | 8/1944 | Hanson | 81/13 |
| 2,491,089 | 12/1949 | Cowden | 81/125 |
| 2,567,352 | 9/1951 | Rozmus | 81/125 |
| 2,664,771 | 1/1954 | Elliott | 81/13 |
| 2,753,747 | 7/1956 | Brown | 81/125 |
| 3,630,107 | 12/1971 | Carr | 81/125 |
| 3,665,791 | 5/1972 | Carr | 81/125 |
| 3,834,253 | 9/1974 | Carr | 81/125 |
| 4,416,173 | 11/1983 | Rebish | 81/DIG. 11 |

*Primary Examiner*—Frederick R. Schmidt
*Assistant Examiner*—Blynn Shideler

[57] ABSTRACT

A tool component for supporting a fastening device (such as a bolt) in a straight and rigid position. When the head of the device and the component are inserted into a socket implement the device itself can be used for leverage to move the material objects being fastened by the device, by inserting the opposite end of said device through the holes, so as to align the holes, in the material object being fastened by said device.

To support said device for facilitating the starting of the installation of same device.

Said component being readily able to be removed from the device once the installation of the device is started so as not to interfere with the completion of the installation of same device.

Said component (FIG. 1) comprising two device supports (20). Said supports having a cutout (22) on the inside surface of the supports, so when same are placed on a fastening device they are able to encompass a portion of the same device (26). With outside diameter of said component sized, so as to be able to be accommodated by a socket implement (28), said supports being joined at one end of each support by a means such as a spring (24) to assist in easier manipulation of the supports.

1 Claim, 1 Drawing Sheet

BOLT STARTER FOR STARTING BOLTS AND THE LIKE THROUGH UNALIGNED HOLES

BACKGROUND

1. Field of Invention

This invention relates to a component for a socket implement for supporting a fastening device (especially a bolt or screw) to facilitate the starting of the device's installation through unaligned holes in the material objects being fastened by the device.

2. Description of Prior Art

Many, if not most, people encounter problems starting the installation of fastening devices (such as a bolt) when the holes in the material objects, that the fastening device is to go through, do not align.

One such tool which can be used to align the holes would be a line-up punch. Users regard this tool as unsatisfactory because when the punch is removed the material objects usually have a way of moving, causing the holes to become unaligned once again. Sometimes the user can employ different methods to hold the material objects once the holes are aligned, such as by hand, but these methods often prove to be very difficult tasks.

Many people, therefore, would prefer to have a tool that would hold the device in a straight and rigid position to enable the person to use the device itself for leverage to move the material objects when the device is inserted through the holes of the material objects being fastened, so as to align the holes. Thereby the holes would stay aligned due to the fact that the device would not have to be removed from the holes of the material objects being fastened by the device.

Many people would prefer to have the same tool readily able to be removed once the installation of the device is started. Whereby the installation of the device can be completed without interference from said tool.

OBJECTS AND ADVANTAGES

Accordingly, I claim the following as my objects and advantages of the invention: to provide a tool to facilitate the starting of the installation of a fastening device such as a sheet metal bolt, tapered bolt, pointed bolt, altered end bolt. When the holes (in the material objects to be fastened by the device) that the device is to go through do not align.

Another object is to provide a tool that can be easily removed from the device after the installation of said device has been started so that the tool will not interfere with the completion of the installation of said device.

Readers will further find objects and advantages of the invention from a consideration of the ensuing description and the accompanying drawings:

DRAWING FIGURES

DRAWING REFERENCE NUMERALS

20 Supports
22 Cutouts
24 Spring

26 Bolt or fastening device
28 Socket Implement
30 Closest material object with hole
32 Back material object with hole
34 Head of bolt, or device

Single-piece Tool—Description

Figure 1:
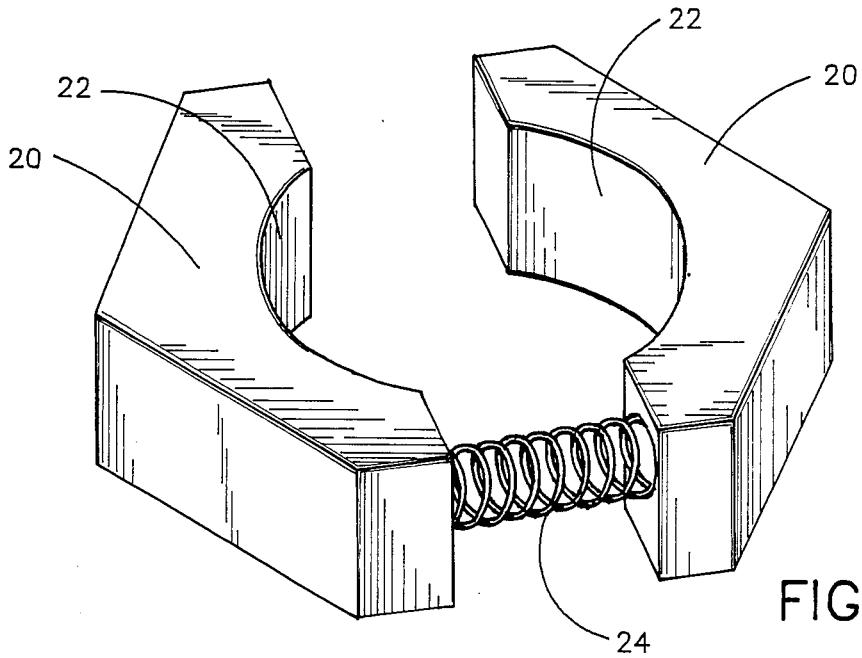
FIG. 1 shows a perspective front view of a one piece component according to the invention.

FIG. 1 shows a single piece tool component according to the preferred embodiments of the invention. The component comprising of two device supports (20) having a cutout (22) on the inside surface of each support. Supports (20) being joined together at one end of each support by a spring (24).

Figure 2:
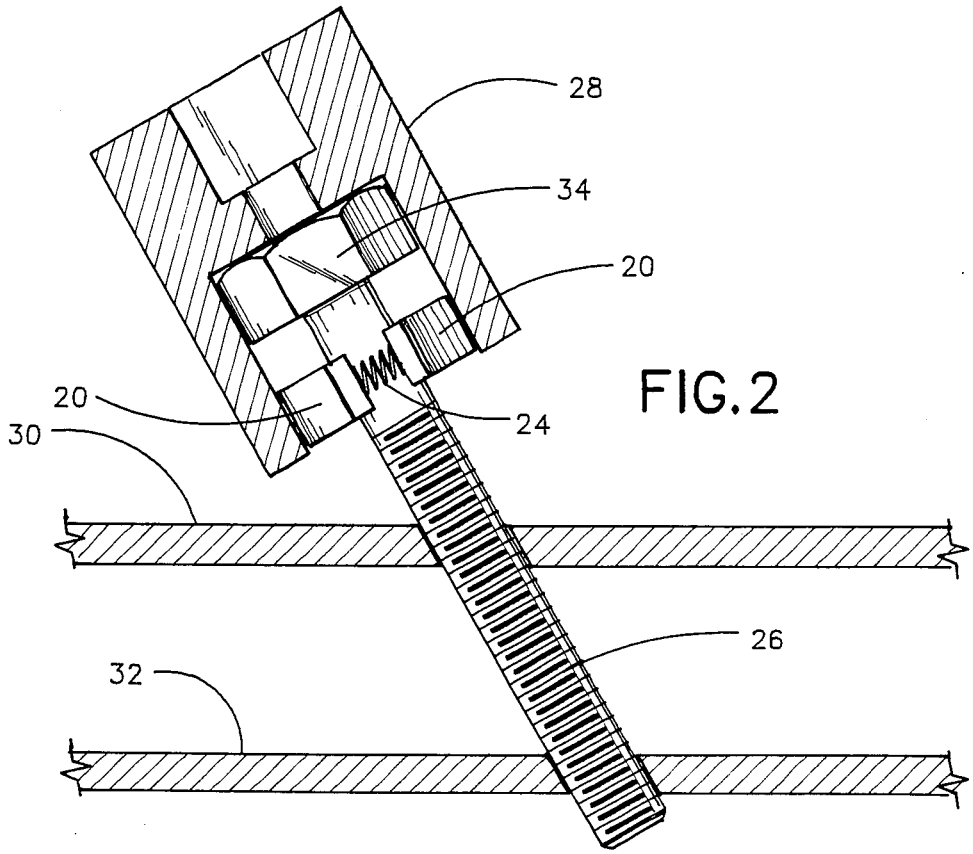
FIG. 2 shows a front view of such tool in use supporting a bolt for leverage while in a socket implement with opposite end of bolt inserted through a hole in the closest material object and into a hole in the back material object.

FIG. 2 shows a front view of the operating procedure of the component. Said component (FIG. 1) comprising of two supports (20) placed on the device (26) with head of said device (34) and said component inserted into a socket implement (28) with opposite end of said device inserted through the hole of the closest material object (30) to be fastened by the device, with the extreme end of the opposite end of the device secure in the hole in the back material object (32) to be fastened by the device. Thus with pressure being applied on said socket implement (28) parallel to the material objects being fastened said device (26) being supported in a straight and rigid position by said component (FIG. 1) can be used for leverage to move either one or both material objects (30–32), thus aligning the holes in the material objects to be fastened by said device. When the holes are aligned the socket implement (28) can be turned to start the installation of said device. When the installation of said device is started the socket implement (28) can be readily removed from said device and said component. Then said component can be readily removed from said device. At this time the installation of said device can be completed without interference from said component (FIG. 1).

Single-piece Tool—Operation

The component of FIG. 1 will be used to support a fastening device (such as a bolt) in a straight and rigid position when the head of the device and the component are both inserted into a socket implement. The user should place the component around the device and insert the head of said device and said component into a socket implement. The opposite end of said device should then be inserted through the hole of the closest material object to be fastened by said device and then into the hole in the back material object to be fastened by said device. The user should then apply pressure on the socket implement parallel to the material objects being fastened by the device, causing one or more of the material objects to move. When the holes are aligned the user should then turn the socket implement (if using a socket wrench the user can employ a handle such as a ratchet handle to facilitate turning the socket) until the installation of said device is started. The user should then remove the socket implement from the device and the component. The user should then remove the component from the device. At this time the device should be ready for completion of installation without interference from said component.

While the above description contains specifications the reader should not construe these as limitations on the scope of the invention, but merely as exemplifications of the preferred embodiments thereof. Those skilled in the art will envision many other possible variations are within the scope. For example skilled artisans will readily be able to change the dimensions and the shapes of the embodiments they can use more supports. They can make the component of alternative materials such as plastic or metals. They can join the supports together by different attachment means such as a leaf spring or a cable or even eliminate the attachment means.

Accordingly, the reader is requested to determine the scope of the invention by the appended claims and their legal equivalents and not by the examples which have been given.

I claim:

1. A tool component being insertable into a socket implement to hold the shaft of a fastening device captive by containing a portion of said shaft therein and thereby aiding the commencement of installation of said fastening device while lateral pressure is applied to said socket implement whereas said tool component being readily able to be removed from said socket and from engagement with said fastening device prior to completion of installation of said fastening device, said tool component comprising.

* * * * *

UNITED STATES PATENT AND TRADEMARK OFFICE

CERTIFICATE OF CORRECTION

PATENT NO. : 4,777,853

DATED : October 18, 1988

INVENTOR(S) : Arlen E. Bauer

It is certified that error appears in the above-identified patent and that said Letters Patent is hereby corrected as shown below:

Column 4, line 11, - Insert -- two opposing jaw portions, each of said jaw portions comprising an exterior portion having four planar surfaces which conform to a portion of the interior of said socket, each of said jaw portions further comprising an interior portion having two planar surfaces and an arcuate section positioned between said interior planar surfaces, each of said interior planar surfaces is associated with one of said interior planar surfaces of said opposing jaw portion thereby forming pairs of interior planar surfaces, said interior arcuate sections adapted to engage said fastening device shaft, and a spring biasing means operatively positioned between one pair of interior planar surfaces to bias the exterior portions into engagement with said interior of said socket, the other pair of interior planar surfaces spaced apart to form a gap means sufficient to allow for removal of said tool component from said socket and said fastening device prior to completion of installation

UNITED STATES PATENT AND TRADEMARK OFFICE

CERTIFICATE OF CORRECTION

PATENT NO. : 4,777,853

DATED : October 18, 1988

INVENTOR(S) : Arlen E. Bauer

It is certified that error appears in the above-identified patent and that said Letters Patent is hereby corrected as shown below:

of said fastening device. --.

Signed and Sealed this

Twenty-ninth Day of August, 1989

*Attest:*

DONALD J. QUIGG

*Attesting Officer*

*Commissioner of Patents and Trademarks*